United States Patent [19]

Ygfors

[11] 4,023,450

[45] May 17, 1977

[54] PLIERS OF PLASTIC

[76] Inventor: Goran Ygfors, 18, Rue Theodore de Banville F-75017, Paris, France

[22] Filed: Feb. 19, 1976

[21] Appl. No.: 659,401

[52] U.S. Cl. ..... 81/418; 81/427
[51] Int. Cl.[2] ..... B25B 7/02
[58] Field of Search ..... 81/418–426; 30/261

[56] References Cited

UNITED STATES PATENTS

| | | | |
|---|---|---|---|
| 3,044,081 | 7/1962 | Robinson | 81/421 |
| 3,140,715 | 7/1964 | Whitten et al. | 81/418 |

*Primary Examiner*—James L. Jones, Jr.

*Attorney, Agent, or Firm*—Strauch, Nolan, Neale, Nies & Kurz

[57] ABSTRACT

Pliers made from a plastic material which is preferably reinforced with glass fibers and made with two lever members hinged together to provide gripping jaws at one end and handles at the other end. The jaws are dimensioned to be slightly elastic and have their meeting faces angled so the faces diverge from the front back toward the hinge and increased pressure on the handle will clamp and deflect the jaws until the faces are in abutment and stops on the handle side of the hinge limit and prevent the jaw deflection movement beyond their full abutment disposition. A plastic resilient member acts on the handles to urge them apart. Auxiliary gripping devices can be attached to extend beyond the nose portions of the jaws.

5 Claims, 8 Drawing Figures

PLIERS OF PLASTIC

This invention relates to pliers of flat-nose pliers type of plastic with two hingedly connected legs and intended to be used, for example at mounting work, for picking up small objects or apparatus details and position them in their intended place and/or desired position.

The basic object of the invention is to produce pliers suitable for said application which render it possible to effect a successively increasing, but to a certain maximum value limited clamping pressure, and to quickly and easily pick up small details, and which are adjustable to different demands and easy to manufacture.

This object is achieved thereby that pliers of plastic with two hingedly connected lever members which are designated as legs, each forming a jaw with clamping surface and a handle, according to the invention are characterized in, that at least the jaws are to some small degree elastic, that the clamping surfaces of the jaws are adapted, upon pivotal motion of the jaws in the direction toward each other, to contact one another first at the outer end portion of the clamping surfaces and between themselves form an angle increasing successively inwards in the pliers, and thereafter by action of increasing clamping pressure on the handles successively abut one another completely, and that shoulders known per se on the portion of the respective handle located closest to the hinge portion of the pliers have such a position, that they get in contact with each other substantially at the same time when the clamping surfaces completely abut each other.

Figure 1:
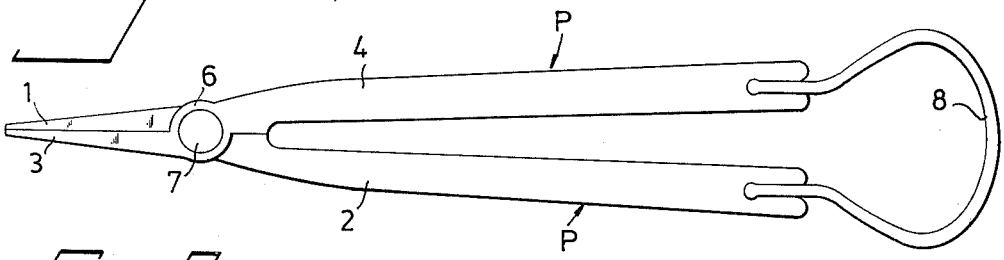
Figure 2:
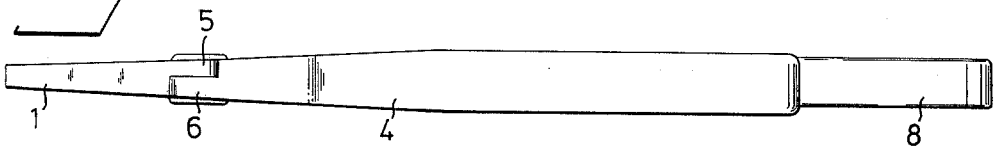
Figure 3:
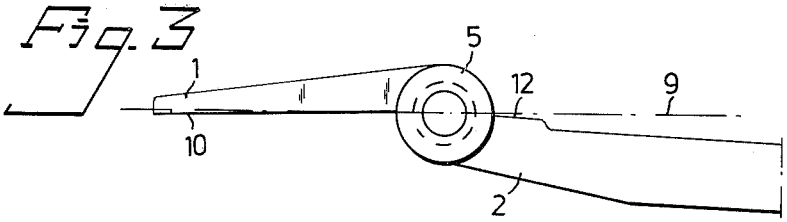
Figure 4:
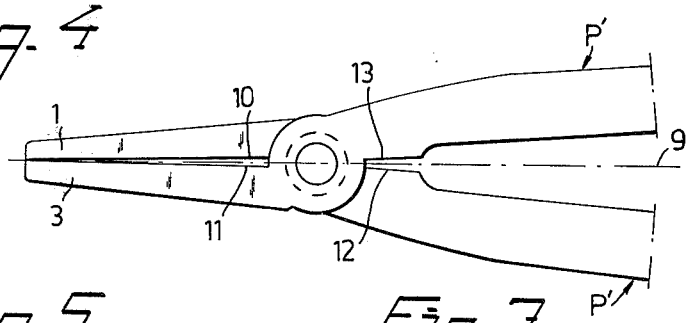

The invention is illustrated by some embodiments shown by way of example in the accompanying drawing, in which FIGS. 1 and 2 are different side views of pliers according to the invention, FIG. 3 is a side view on enlarged scale of a portion of one leg in a pliers according to FIG. 1, FIG. 4 also is a side view on enlarged scale of a portion of a pliers in FIG. 1, FIGS. 5–8 each are a side view of a portion of legs for a pliers according to FIG. 1 provided with different gripping members.

The pliers according to the invention shown in FIGS. 1 and 2 comprise two lever members or legs, each of which consists of a jaw 1 and, respectively, 3, a handle 2 and, respectively, 4 and between the same a hinge portion 5 and, respectively, 6. The legs 1, 2, 5 and 2, 4, 6, respectively, are entirely made of plastic and preferably reinforced with glass fibers. The jaws 1, 3 are to a small degree resilient or elastic. The hinge portions 5, 6 guided against each other are connected to each other by means of a hinge pin 7, also of plastic. At the outer end portions of the handles 2, 4 a resilient strip 8 of plastic is attached and tends to move the handles apart and thereby to open the jaws 1, 3. When the jaws are closed, as shown in FIG. 1, the handles 2, 4 are subjected, against the action of the resilient strip 8, to being pressed together by the action of the forces P', P', exerted, for example, by a hand.

In FIG. 3, which shows a portion of one pliers leg, the central plane through the pliers and the central line of the hinge pin 7 is indicated by a dash-dotted line 9. The jaw 1 has a clamping surface 10 with such a position that, in the position shown in FIG. 3 at the point of the jaw, it is located slightly, for example 0.25 mm, below the central plane 9. The handle 2 is provided adjacent the hinge portion 5 with a shoulder 12, which also is located slightly, for example 0,2 mm, below the central plane 9. The leg 3, 4, 6, as shown in FIG. 4, also comprises a clamping surface 11 and a shoulder 13, both of which are arranged in the same manner as on the leg 1, 2, 5. Due to the described positions of the clamping surfaces 10, 11 and shoulders 12, 13, the points or outer end portions of the jaws 1, 3, upon motion of the handles 2, 4 in the direction toward each other, first move against each other, as shown in FIG. 4, by action of the forces P', P', and the clamping surfaces 10, 11 form between themselves an angle increasing successively from the place of contact at the point of the jaws, and the shoulders 12, 13 are located spaced from each other. During the continued pressing together of the handles 2, 4, the clamping surfaces are moved increasingly closer to each other, with resilience in the jaws 1, 3, until the clamping surfaces substantially completely abut each other whereby at the same time also the shoulders 12, 13 abut each other.

Owing to the described design, the outer end portions of the jaws can easily and smoothly seize a small object, whereafter if desired the clamping pressure about the object can successively be increased until the shoulders 12, 13 abut each other and stop a further increase of the clamping pressure. The risk of damaging the object is reduced both by the successive increase of the clamping pressure and by its limitation.

The pliers are intended for use primarily at precision tool-making and similar work when relatively small objects or apparatus details and the like prior to or during their mounting must be seized or picked up with the pliers. The pliers according to the invention, therefore, preferably are provided with gripping members projecting ahead of the jaws 1, 3, as shown in FIGS. 5–8. In these Figures, certainly, a portion of only one pliers leg is shown, but a second leg in the same pliers, of course, is provided with a gripping member usually of the same design.

Figure 5:
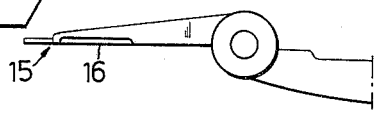
Figure 7:
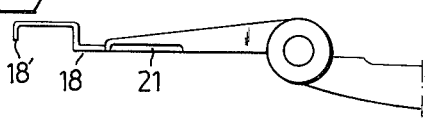
Figure 6:
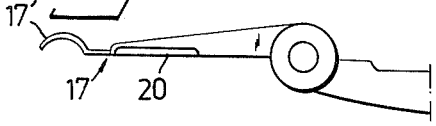
Figure 8:
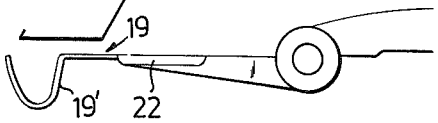

According to FIG. 5, the entire gripping member 15 has the form of a plane sheet with upward-bent or hobbed edges 16 along the outer sides of the jaws. The gripping member 15, which in this case and in the cases described hereinafter preferably is made of phoshor bronze, is by heat secured on the clamping surface 10.

FIGS. 5–8 show gripping members 17, 18, 19, which also comprise a plane base portion attached to the clamping surface and upward-bent or hobbed edges 20, 21, 22 adjacent the outer sides of the respective jaw. The portions 17', 18', 19' of the gripping members 17–19 located freely in front of the respective jaw are designed in different ways, according to the form of the object to be seized by the pliers. The described design of the gripping members, thus, renders it possible to adjust a pliers to the special demand they are to meet. The gripping members are exchangeable, but in many cases it should be more advantageous to have one pliers for each type of gripping members required instead of exchanging gripping members on one and the same pliers.

The characterizing feature of the pliers jaws, implying that their outer end portions meet first, can be applied also to the gripping members, so that their outer end portions or the outer portions of their plane portions located closest ahead of the jaws meet first.

The pliers according to the invention described above and shown in the drawing can, of course, be modified within the scope of the invention. The upward-bent or hobbed edges of the gripping members, for example, can be abandoned or replaced by suitable projections on the contact surface of the gripping member against the jaw, and the clamping surfaces of the jaws can be displaced in parallel slightly relative to the position shown in FIG. 3, so that the clamping surfaces earlier or later contact each other and clamp together the handles. The position of the shoulders, of course, must be adjusted accordingly.

I claim:

1. Pliers with two lever members comprising plastic material and a pivot means joining the lever members on a pivot axis intermediate their two ends, each lever member having a jaw with clamping surface on one side of the pivot means and a substantially longer and stronger handle on the other side of the pivot means: characterized in that the jaws have an elasticity and size relative to the handle to permit a limited flexing and that the clamping surfaces of said jaws are disposed relative to the pivot axis to enable said jaws upon pivotal motion of the handles in a direction toward each other to make contact first at the outer end portion of the jaw clamping surfaces to thereby, between said clamping surfaces, form an angle diverging toward the pivot means and thereafter, by action of increased clamping pressure on the handles, said jaws successively deflect until said clamping surfaces abut each other completely; and limit shoulders are provided on the portions of the handles located adjacent the pivot means of the pliers and are constructed so that they contact each other substantially at the same time the clamping surfaces abut each other completely to prevent further deflection of said jaws.

2. Pliers according to claim 1, further characterized by a gripping member on each of said plastic jaws and projecting ahead of the associated jaw so that said gripping members engage upon movement of said jaws toward each other, each gripping member having a substantially plane base portion secured by heat to the clamping surface of the plastic jaw material.

3. Pliers according to claim 2, wherein the base portion of each gripping member has up bent edges which engage the outer side surfaces of the associated jaw.

4. Pliers as defined in claim 1, wherein said plastic material includes glass fibers.

5. Pliers as defined in claim 1, wherein a resilient plastic strip engages the ends of both handles and provides a biasing force urging the handles away from each other.

* * * * *